United States Patent [19]

Wallis

[11] 4,157,084

[45] Jun. 5, 1979

[54] FUEL INJECTION SYSTEM AND METHOD FOR INTERNAL COMBUSTION ENGINE

[76] Inventor: Marvin E. Wallis, 5535 Longfellow Rd., Santa Barbara, Calif. 93111

[21] Appl. No.: 834,875

[22] Filed: Sep. 20, 1977

[51] Int. Cl.[2] ..... F02N 17/00; F02B 3/00

[52] U.S. Cl. ..... 123/179 L; 123/32 AE; 123/33 C; 123/139 AW; 123/179 G

[58] Field of Search ..... 123/32 AE, 32 EG, 33 R, 123/33 C, 33 E, 34 R, 35, 119 R, 131, 139 AW, 179 G, 179 L, 180 R, 180 A, 32 EH

[56] References Cited

U.S. PATENT DOCUMENTS

| | | | |
|---|---|---|---|
| 1,060,053 | 4/1913 | Winkler | 123/34 |
| 1,460,667 | 7/1923 | Good | 123/131 |
| 1,624,604 | 4/1927 | Kings | 123/119 A |
| 1,625,997 | 4/1927 | Gronkwist | 123/119 A |
| 1,627,727 | 5/1927 | Charter | 123/32 AE |
| 2,091,987 | 9/1937 | Honn | 123/33 R |
| 2,223,381 | 12/1940 | Mock | 123/139 AW |
| 2,681,647 | 6/1954 | Wille | 123/131 |
| 2,960,976 | 11/1960 | Cassell et al. | 123/139 AW |
| 3,661,129 | 5/1972 | Uozumi et al. | 123/139 HW |
| 3,704,702 | 12/1972 | Aono | 123/179 G |

*Primary Examiner*—Charles J. Myhre
*Assistant Examiner*—David D. Reynolds
*Attorney, Agent, or Firm*—Finnegan, Henderson, Farabow & Garrett

[57] ABSTRACT

An air and fuel mixing device incorporates a Venturi throat or other mixing means for feeding a highly combustible mixture of fuel and pressurized air to an electrical fuel injector valve or directly to the intake manifold in a system for starting an internal combustion engine. The system replaces the choke in a conventional electrical ignition type internal combustion engine. The fuel injector valve is controlled to inject a limited quantity of a highly combustible atomized air-fuel mixture into the engine intake manifold during engine startup. Startup is achieved with minimum fuel waste and produces a minimum of exhaust pollutants. A modified form of the invention is shown as employed in a fuel injection type internal combustion engine system wherein high pressure air-fuel mixture is fed to the fuel injectors solely through use of a conventional low pressure fuel pump and air supply. The injectors operate to discharge a highly volatile, combustible, air-fuel mixture under pressure, instead of raw fuel thus significantly increasing combustion efficiency during engine startup to minimize fuel waste and reduce deleterious exhaust emissions. Another modified form of the invention is shown wherein the system is employed to feed a mixture of fuel and pressurized air to the engine intake manifold in response to an acceleration command from the engine throttle control during normal engine operation. This eliminates the need for the notoriously troublesome carburetor accelerator pump now in conventional use.

30 Claims, 5 Drawing Figures

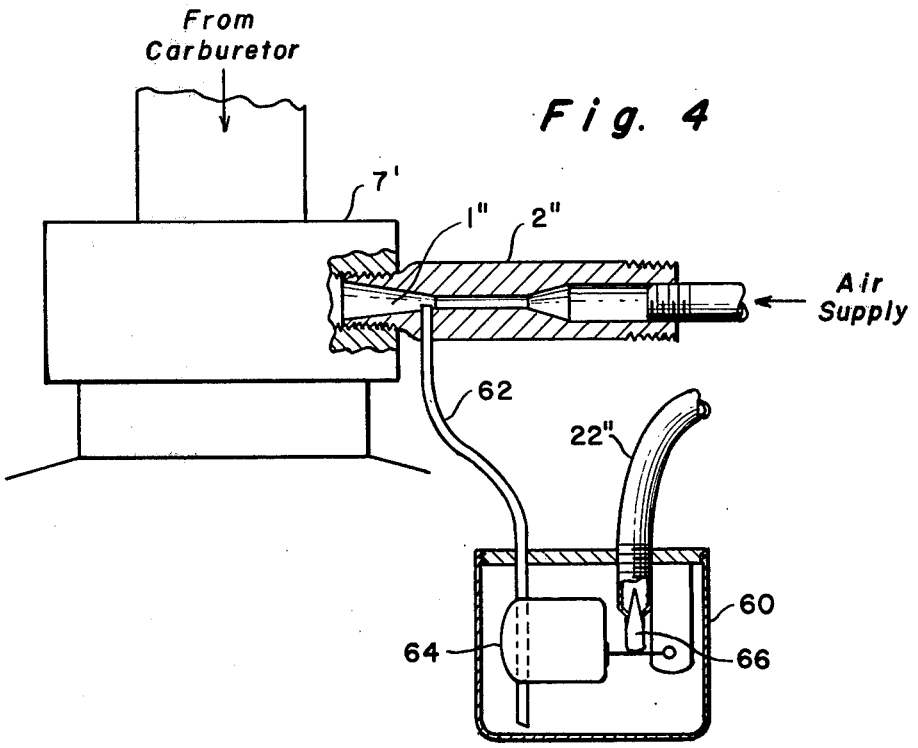
Fig. 4
Fig. 5
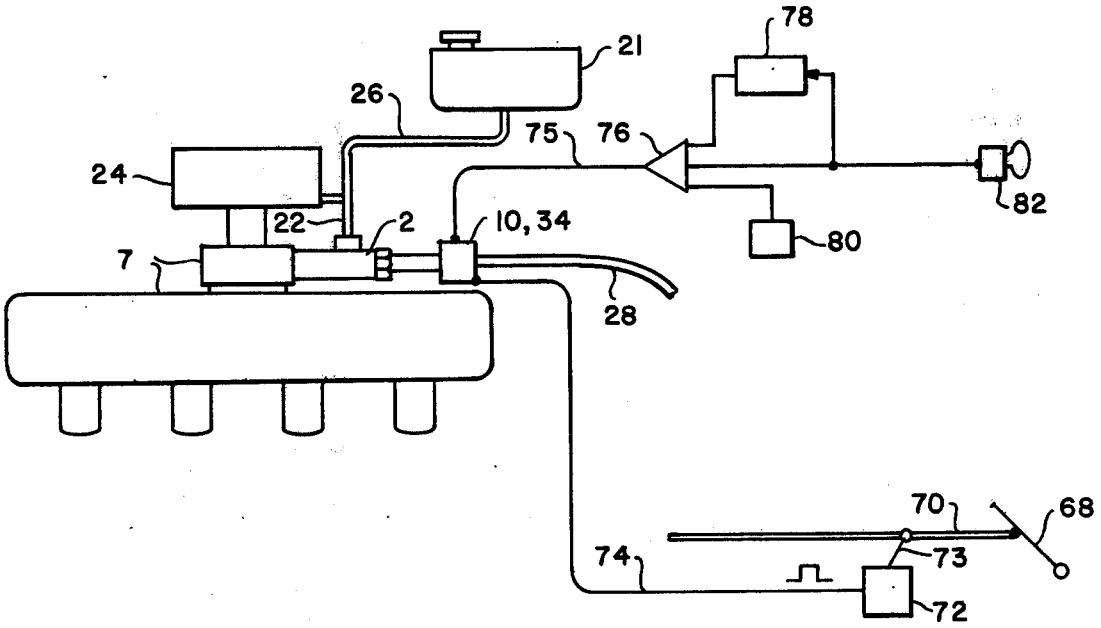

FUEL INJECTION SYSTEM AND METHOD FOR INTERNAL COMBUSTION ENGINE

BACKGROUND OF THE INVENTION

Fuel waste and generation of pollutants are problems experienced in present day automobile internal combustion engines as a result of the conventional choke mechanism, which is a fuel enriching device used to start a cold engine. The choke apparatus is either manually operated from a dashboard control or is thermostatically operated in response to the temperature of the engine via throttle linkages or electronic spray nozzle injectors.

In every instance these systems put raw fuel into the intake manifold of the cold engine and, while these devices serve the purpose of starting a cold engine, they cause excessive fuel waste and resulting high emissions that pollute the atomosphere as well as cause excessive engine wear. It is known that approximately 25 to 30% of the emissions produced during a so-called CVS "cold start" EPA emission test result from the operation of the choke apparatus.

The reason for this is that in an internal combustion engine system vacuum and air flow are at their lowest during engine startup. The gasoline and air are both generally cold and this makes it virtually impossible to produce a volatile and highly combustible atomized, efficiently mixed, air-fuel mixture during the engine startup cycle. Even when raw fuel is atomized into the engine with fuel injectors there is poor mixing of the fuel with the available air supply and this results in the very rich burn which causes air pollution and significant energy waste in starting present engine systems.

The injection type choke in conventional use is superior to the conventional carburetor type choke but the injection type system uses raw fuel and requires a high presure fuel pump employing a complex drive system to operate the injector valve and is still far from an efficient system. It can only spray raw fuel into the intake manifold or combustion chambers and efficient mixing with the available air supply is virtually impossible. With either the carburetion or injection type choking system, a major portion of the fuel condenses in the intake manifold and on the walls of the combustion chambers rather than mixing with the available air supply whereupon the condensed, unmixed fuel contributes virtually no engine startup energy, and furthermore converts to carbon and enriches the engine exhaust with significant amounts of carbon monoxide.

Thus, even the relatively high degree of atomization realized with the conventional cold start injector, which sprays straight fuel, does not provide the complete air mixing necessary for good combustion and does not significantly improve engine startup efficiency.

A further problem experienced with conventional enriching devices, where improper air-fuel mixing takes place, is the pronounced cooling effect which can lead to ice clogging of the carburetor when the atmosphere is cold and humid. Further, automatic chokes often stick or stay on longer than necessary causing undue fuel waste and air pollution. Hand operated chokes are especially troublesome because operators forget to move them to the off position when their operation is no longer needed.

OBJECTS AND SUMMARY OF THE INVENTION

Accordingly it is a principal object of my invention to provide an improved internal combustion engine fuel injection system and method.

A further object is to provide an improved startup system and method for an internal combustion engine wherein a thoroughly mixed quantity of air and highly atomized fuel is injected into the engine during startup to minimize fuel waste and produce minimum pollutants during the startup cycle.

Still another object is to provide a fuel injection system and method for an internal combustion engine wherein the fuel injectors do not require the conventional, expensive, high pressure fuel pump normally used with fuel injector systems.

Still a further object is to provide a fuel injection system for an internal combustion engine which eliminates the need for a conventional carburetor accelerator pump for supplying an extra charge of fuel to the engine in response to an acceleration command from the throttle control.

Additional objects and advantages of the invention will be set forth in part in the description which follows, and in part will be apparent from the description, or may be learned by practice of the invention. The objects and advantages of the invention may be realized and obtained by means of the instrumentalities and combinations particularly pointed out in the appended claims.

To achieve the foregoing objects and in accordance with the purpose of the invention, as embodied and broadly described herein, the apparatus of the invention comprises a fuel injector valve having an inlet and further including an outlet nozzle in communication with the intake manifold of the internal combustion engine, air-fuel mixing means connected to supply an air-fuel mixture to the injector valve inlet and having means for directing a flow of pressurized air to said inlet through a mixing chamber, means for supplying fuel into said flow of pressurized air whereupon the fuel is mixed with the air in the mixing chamber, and control means for operating the fuel injector valve during engine startup whereby a mixture of air and highly combustible, atomized fuel is fed into the engine intake manifold through the injector valve.

In accordance with a further aspect of the invention, a fuel injection system for an internal combustion engine is provided comprising a fuel injector valve arranged to supply fuel to a combustion chamber of the engine, the valve having an inlet and further including an outlet nozzle in communication with a fuel supply passage to the combustion chamber, air-fuel mixing means connected to supply a air-fuel mixture to the injector inlet and having means for directing a flow of pressurized air to the inlet through a Venturi throat, a fuel source including a low pressure pump for supplying fuel into the flow of pressurized air, the fuel being drawn into and mixed with the flow by the pressure differential produced at said Venturi throat, air supply means for supplying air to the combustion chamber, and control means for operating the fuel injector valve in synchronism with the operating cycle of the engine whereby a highly combustible mixture of air and highly atomized fuel is fed by the injector valve into the combustion chamber in a mix with air from the air supply means during each fuel intake cycle.

In accordance with still another aspect of the invention, a method is provided for starting an internal combustion engine having carburetion means including a throttle control arranged to supply an air-fuel mixture to the engine through an intake manifold, the method comprising the steps of closing the throttle control to minimize the supply of air-fuel mixture from the carburetion means to the engine, operating the starter motor and ignition of the engine, and injecting, while the throttle control is closed and the starter and ignition are in operation, a limited charge of pressurized air mixed with fuel into the intake manifold through a fuel injector valve located downstream of the throttle control whereby a quantity of air mixed with highly atomized fuel is introduced into the engine to induce engine startup.

BRIEF DESCRIPTION OF THE DRAWINGS

The accompanying drawings, which are incorporated in and constitute a part of this specification, illustrate preferred embodiments of the invention and, together with the description, serve to explain the principles of the invention.

In the drawings:

FIG. 4 is a schematic diagram illustrating a simplified form of the invention not utilizing a separate fuel injector valve.

FIG. 5 is a diagram depicting various control systems for the apparatus of the invention.

DETAILED DESCRIPTION OF EMBODIMENTS

Figure 1:
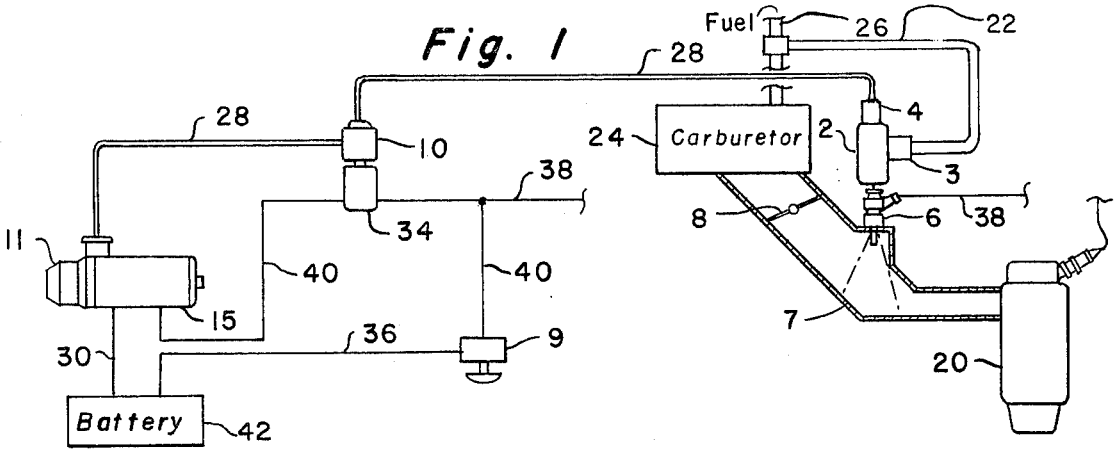
FIG. 1 is a schematic diagram illustrating the fuel injection system of the invention as incorporated in a conventional carburetion type internal combustion engine for operation during engine startup.

FIG. 1 schematically shows a first embodiment of the invention wherein a conventional ignition-operated internal combustion engine 20 is fed, under normal operating conditions, with an air-fuel mixture through an intake manifold 7. A conventional carburetor 24 having a throttle valve 8 provides a regulated flow of atomized fuel and air in the usual fashion.

An electrically controlled fuel injector valve 6 is mounted on the intake manifold 7 downstream of the throttle control 8. The injector valve 6 is fed a supply of premixed fuel and pressurized air from a mixing device 2. The latter receives a supply of fuel from a conduit or line 22 coupled to the main fuel supply line 26 to carburetor 24. Pressurized air is supplied to the mixing device by a conduit or line 28 coupled to an air compressor 11. The compressor is driven by an electric motor 15 powered, for example, by the battery 42 utilized in the engine ignition system. If desired, the compressor can be mechanically driven from the engine itself, thus eliminating the need for the separate motor 15. A cutoff valve 10 is provided in the air line 28 and is electrically controlled by a solenoid 34.

A dashboard-mounted control switch 9 connected to the battery 42 by electrical lead 36 is arranged via leads 38 and 40 to enable simultaneous energization of motor 15, solenoid 34, and injector valve 6 so that a limited charge of a highly atomized air-fuel mixture is injected into intake manifold 18 during the engine startup cycle.

Figure 2:
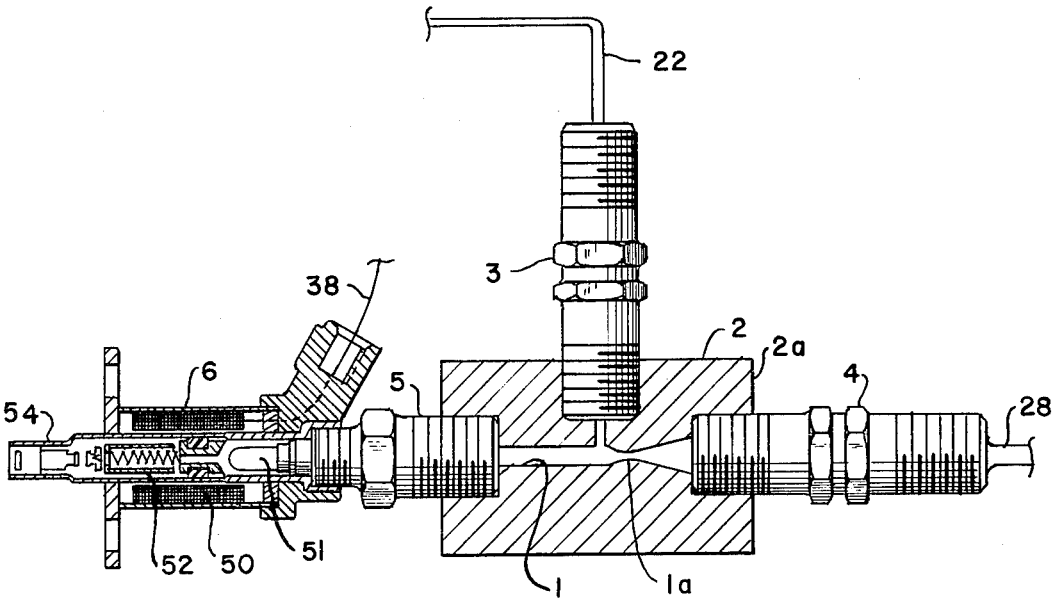
FIG. 2 is a schematic diagram showing the fuel injector valve and air-fuel mixing apparatus of FIG. 1.

The details of the fuel injector valve 6 and the air-fuel mixing device 2 are illustrated in FIG. 2. Fuel injector valve 6 is of conventional design and may be of the coil and armature type such as supplied, for example, by the Bosch Company of West Germany. Injector valve 6 has an inlet 51 for receiving a charge of mixed air and fuel and further has a swirl nozzle 54 for discharging a highly atomized spray of air-fuel mixture into the engine intake manifold. A solenoid winding 50 and axially movable armature 52 operate to open and close the valve unit in response to control signals on line 38.

The air-fuel mixing device 2 includes a block **2*a* of brass, aluminum, or other suitable material having a mixing chamber 1 which is coupled by an adaptor 5 to the inlet 51 of the injector valve. A second adapter 3, including a check valve, couples the fuel supply line 22 to the mixing chamber 1 via a Venturi passage 16. A third adaptor unit 4, also incorporating a check valve, couples the pressurized air supply line 28 to the mixing chamber 1 via a Venturi throat 1*a***.

Air under pressure flowing from supply line 28 through Venturi throat **1*a* and into mixing chamber 1 draws fuel into the mixing chamber through the Venturi passage 16. The fuel is drawn into the mixing chamber by the pressure differential produced at the Venturi throat in accordance with the wellknown principle govered by Bernoulli's equation. When the armature 52 in the fuel injector valve 6 is operated to open the valve, a charge of pressurized air and highly atomized fuel flows from mixing chamber 1 through the injector valve and is discharged through swirl nozzle 54** into the engine intake manifold. Flow of the air-fuel mixture through the injection valve and swirl nozzle causes still further mixing action and as a result the air and fuel discharge through the nozzle is very thoroughly mixed.

In operation, the system illustrated in FIGS. 1 and 2 functions as a replacement of the conventional engine choke system. To start the engine the operator actuates the engine starter and ignition and at the same time momentarily actuates control switch 9 for a brief interval such as one or two seconds. Actuation of the control switch opens the normally closed solenoid valve 10 allowing air under pressure to flow from compressor 11 via conduit 28 to the air-fuel mixing unit 2. Simultaneously, coil 50 of the fuel injector 6 is energized via control lead 38 to open the injector valve. Air under pressure of, for example, 35 to 100 p.s.i. passes through Venturi throat **1*a* and into mixing chamber 1. The reduced pressure induced at Venturi passage 16 by this flow causes fuel from supply line 22 to be drawn into the mixing chamber, where it is atomized and mixed with the flow of air. Further atomization and mixing takes place as the mixture passes through the injector valve and is discharged through swirl nozzle 54**.

This finally atomized mixture of air and fuel is highly combustible and causes the cold engine to start instantly as all four, six, or eight cylinders receive an equal charge of the finally atomized mixture. During the startup cycle, throttle control 8 is preferrably kept fully closed to cut off the flow of air-fuel mixture from carburetor 24.

Should the engine hesitate or begin stalling during or just after startup, a second momentary actuation of control switch 9 brings all cylinders instantly to life and as a general rule no additional fuel is required for startup. Since control switch 9 is spring biased to cause cut off valve 10 in air line 28 to close when the switch is released, only a limited quantity of fuel is used during the startup cycle.

Because the startup air-fuel mixture introduced by injector valve 6 is so finely atomized and completely mixed, resulting in a highly combustible volatile air-fuel mixture, more complete combustion is produced and deleterious exhaust emissions are kept to a minimum during the startup cycle. Air compressor 11 may be an extremely low cost unit and would represent a drain of less than one ampere or one hundredth of a horsepower on the system. Automatic chokes used in conventional systems represent a drain several hundred times this amount because of the high current withdrawal from the battery required due to the longer use of the starting motor necessary to get the cold engine running.

Further, whereas conventional cold start fuel injector systems require a fuel pump that must develop 35 to 50 p.s.i. fuel pressure, the injector system of the invention requires only a conventional low pressure fuel pump such as is presently used on carburetion-type fuel control systems.

FIG. 4 shows a modified form of the invention employing a simplified arrangement eliminating the fuel injection valve and check valves associated with the air-fuel mixing unit. In the system shown, the mixing chamber 1'' of the air-fuel mixing unit 2'' communicates directly with the engine intake manifold 7'. Gasoline is supplied via a feed line 62 from a float chamber 60. A supply of gasoline is maintained in the chamber 60 by a metering valve 66 actuated by a float 64 in convention fashion.

In this system the air-fuel mixing action provided solely by the flow of pressurized air through chamber 1'' creates sufficient atomization and mixing to achieve rapid and efficient engine startup. As will be appreciated, a solenoid actuated valve, not shown and similar to valve 10, may be placed in the air supply line to mixing chamber 1'' and fuel supply line 22'' to prevent siphoning fuel from tank 60 during times start-up assist is not needed. It will also be appreciated that this simplified form of the invention may be suitable for use on less complicated engines, such as those used in motorcycles or boats, or with engines normally operating in more moderate environments.

With any of the arrangements shown, the preferred air-fuel mixture is in the range from 14 parts air to 1 part fuel, which is stoichometric, to 1 part air to 1 part fuel.

Figure 3:
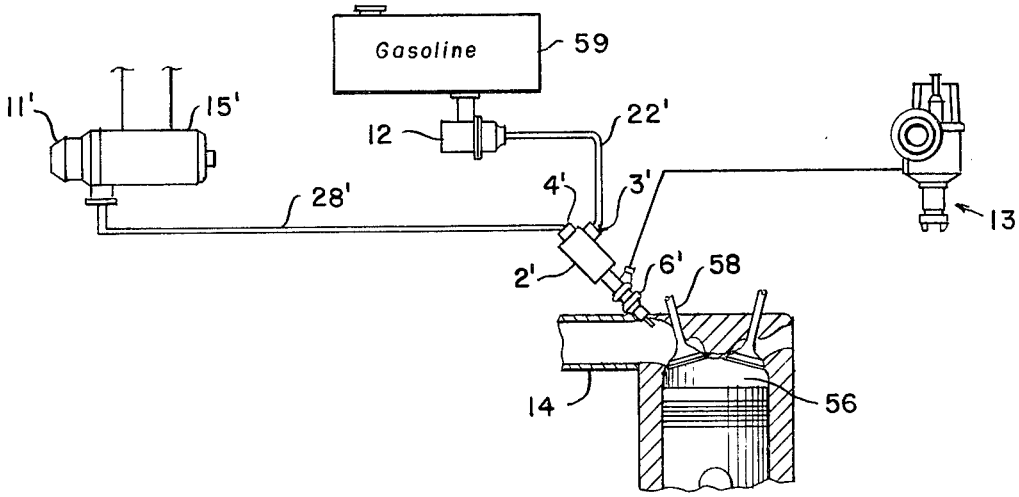
FIG. 3 is a schematic diagram illustrating an alternate embodiment of the invention wherein my novel air-fuel mixing apparatus is incorporated for use in a fuel injection type internal combustion engine.

Referring to FIG. 3, another preferred embodiment of the invention is described. The schematic diagram of FIG. 3 depicts a fuel injection combustion system wherein an air intake manifold 14 is employed in a conventional manner to supply air at atmospheric pressure to a combustion chamber 56 through an intake valve 58. A conventional fuel injector valve 6', identical to valve 6 described in connection with FIG. 2, is located in proximity to intake valve 58 and is controlled by a conventional distributor mechanism 13 to spray a pressurized fuel charge into the combustion chamber during the intake cycle when valve 58 is open.

An air-fuel mixing unit 2', which may be identical to the unit 2 shown in FIG. 2, or the unit 2'' shown in FIG. 4, is employed to feed a pre-mixed pressurized air-fuel mixture into the injection valve. An air compressor 11', which may be identical to the compressor system described above, supplies pressurized air to the mixing unit 2' via a conduit or pressure line 28'.

A fuel supply line 22' feeds fuel from a fuel supply tank 59 into the air-fuel mixing unit 2'. A low pressure fuel pump 12, similar to that used in conventional carburetion-type internal combustion engines, assures positive delivery of fuel from the tank to line 22'. An individual fuel injector valve 6' is employed with each combustion chamber and the several injectors may be fed by individual air-fuel mixing units 2' or by a single mixing unit having a plurality of output lines feeding all of the injector valves in parallel. As with the system of FIGS. 1 and 2, the air compressor 11' serves as the pressure source for operating the injection valves and consequently the complex high pressure fuel pump used with conventional fuel injection systems is not required. The main supply of air for combustion is the manifold 14 such that air compressor 11' need only be a low cost, low capacity battery-powered unit which is less of an energy drain on the engine system than is the high pressure electric fuel-pump required with present fuel injector systems.

The fuel injection system shown in FIG. 3 operates with improved fuel economy and substantially lower emissions than convention fuel injection systems. The system is even more efficient than the well-known stratified charge engine since the initial rich fuel mixture used in the latter system to improve combustion is not necessary. Furthermore, as in the case of the system shown in FIGS. 1 and 2, the FIG. 3 system operates with improved startup efficiency since the highly atomized, completely mixed air-fuel charge supplied by the fuel injectors 6' enables highly efficient engine startup wherein fuel waste and deleterious emissions are kept to a minimum, as described above.

It will be appreciated that a metering valve can be used in lieu of the preferred Venturi throat to mix the air and fuel. That is, air and fuel can be premixed by transmitting gasoline under pressure into a mixing section and using baffles in the mixing section to ensure the supply of a highly combustible volatile air-fuel mixture to the injector valve. In both cases, air under pressure is used to mix the air and fuel and distribute the mixture to the engine.

FIG. 5 shows a system similar to that depicted in FIG. 1 with modified forms of control circuits for actuating the solenoid valve 10, 34. Also, the FIG. 5 system is shown without the injector valve 6 and check valves 3 and 4, but may incorporate these units if desired.

Solenoid valve 10, 34 is connected by a line 75 into the engine ignition circuit so that when the ignition switch 82 is actuated to start the engine, valve 10, 34 is opened to cause mixed gasoline and air under pressure to be injected into manifold 7 through the air-fuel mixing unit 2 to provide a highly combustible air-fuel mixture in the manner previously described. Circuit 75 is also arranged to connect the compressor drive motor 15 (FIG. 1) to the battery power supply 42 so that air line 28 is pressurized.

The control circuit shown in FIG. 5 includes a gating circuit 76 which activates line 75 only if inputs are also simultaneously supplied from a timing circuit 78 and an engine temperature sensor 80. The latter conditions gating circuit 76 only if the engine is cold, such as may be determined, for example, by a thermocouple unit fixed to the engine block.

Timer circuit 78 conditions gate 76 only for a limited interval, such as two or three seconds, following initial actuation of ignition switch 82. Timer 78 may comprise, for example, a single-shot multivibrator circuit. Thus, circuits 75, 76, 78, and 80 enable automatic control of air-fuel mixing unit 2, eliminating the need for the previously described manual switch. The control circuits furthermore operate to disable the system when the engine is already warm and the injection of the highly atomized start-up mixture is not needed. In addition, timer 78 shuts the system down after a sufficient charge of fuel has been applied, thus preventing fuel waste or engine flooding in the event the operator holds the ignition switch on too long.

FIG. 5 also illustrates a control arrangement that permits the mixing unit of the invention to perform the function presently performed by the mechanical acceleration pump in use on conventional carburetor devices. The accelerator pedal or throttle control 68 is connected by a linkage 70 to the throttle actuator on the carburetor in the usual fashion. A motion sensitive switching device 72 is coupled to linkage 70 by a pivotable arm 73 and the switch 72 is connected via line 74 to the solenoid valve 10, 34 of the apparatus of the invention.

When the operator accelerates by depressing pedal 68, the motion sensing mechanism in switch 72 detects the accelerating action and applies a limited duration signal over line 74 to the valve 10, 34. This activates the system of the invention and causes a charge of highly combustible air-fuel mixture to be pressure-injected into the manifold 7, providing the necessary fuel-feed assist. The complicated, often unreliable mechanical acceleration pump presently in use thus may be eliminated.

Thus, in accordance with the preferred embodiments hereinabove described, it is seen that in accordance with the present invention, a fuel injector valve is utilized having an inlet and further including an outlet nozzle in communication with the intake manifold of the engine. As exemplified in the above described embodiments, the fuel injector valve is illustrated as either of the valves 6 or 6'. Further, air-fuel mixing means are utilized to supply an air-fuel mixture to the injector valve inlet and incorporate means for directing a flow of pressurized air to the inlet through a mixing chamber. As exemplified in the above-described embodiment, the air-fuel mixing means includes the mixing units 2, 2', and 2'' with their associated air compressor systems 11 and 11' and supply conduits 28 and 28'. Still further, in accordance with the invention, there is provided means for supplying fuel into the flow of pressurized air whereupon the fuel is mixed with the pressurized air in the mixing chamber. As has been described in connection with the preferred embodiments, the pressure differential generated by the flow of air through Venturi throat 1*a* draws fuel through Venturi passage 1*a* into mixing chamber 1. Still further, the invention contemplates the use of control means for operating the fuel injector valve during engine startup whereby a mixture of air and highly atomized fuel is fed into the engine intake manifold through the injector valve. As exemplified in the embodiments described in connection with FIGS. 1 and 2, the control means includes the electrical control switch 9, leads 38 and 40 and power source 42 which operate to control the coil 50 in the injector valve whereby the pressurized charge of air in line 28 is released through the injector valve to introduce a highly atomized air-fuel mixture into the intake manifold. As exemplified in the embodiment of FIG. 3, the control means includes the distributor mechanism 13.

It can further be seen that, in accordance with the embodiment described in connection with FIG. 3, the invention contemplates the employment of a fuel injector valve and air-fuel mixing means and that as exemplified in the FIG. 3 embodiment, these elements are illustrated as valve 6' and mixing device 2', respectively. Further in accordance with this aspect of the invention there is provided a fuel source including a low pressure pump. As exemplified in the described embodiment, the fuel source includes tank 59, pump 12, and fuel line 22'. Still further, there are provided air supply means and control means for operating the fuel injector valve in synchronism with the operating cycle of the engine. As exemplified in the FIG. 3 embodiment, the air supply means is illustrated as air intake manifold 14 and the control means includes the distributor unit 13.

It will be appreciated that various changes in the form and detail of the above described preferred embodiments may be effected by persons of ordinary skill without departing from the true spirit and scope of the invention.

What is claimed is:

1. Apparatus for supplying a volatile airfuel mixture to an internal combustion engine during engine startup comprising, in combination:

an air-fuel injector valve having an inlet and further including an outlet nozzle in communication with the intake manifold of the engine;

air-fuel mixing means connected to supply an air-fuel mixture to said injector valve inlet and including a mixing chamber and means for directing a flow of pressurized air to said inlet through said mixing chamber;

means for supplying fuel into said flow of pressurized air whereupon said fuel is mixed with said air in said mixing chamber; and control means for operating said air-fuel injector valve during engine startup whereby a mixture of air and highly combustible, atomized fuel is fed to said engine intake manifold through said injector valve.

2. The apparatus of claim 1 wherein said internal combustion engine includes carburetion means having a throttle control arranged to supply an air-fuel mixture to said engine through said intake manifold and wherein said air-fuel injector valve is coupled to said manifold downstream of said throttle control.

3. The apparatus of claim 1 wherein said air-fuel mixing means comprises:

an air compressor;

a conduit connected to supply pressurized air from said compressor to said mixing chamber; and a selectively operable cutoff valve in said conduit for regulating the supply of pressurized air to said air-fuel injector valve.

4. The apparatus of claim 3 further comprising a check valve located in said conduit adjacent the point where the latter is coupled to said mixing chamber.

5. The apparatus of claim 3 wherein said air-fuel mixing means further comprises:

a Venturi throat communicating with said mixing chamber and constructed and arranged such that said fuel is drawn into and mixed with said flow of pressurized air by the pressure differential produced at said Venturi throat.

6. The apparatus of claim 3 wherein said cutoff valve and said air-fuel injector valve include solenoid actuator means and wherein said control means comprises manually operable electrical switch means connected to simultaneously energize said solenoid actuators whereby an operator can manually control said air-fuel mixing means and said air-fuel injector valve during engine startup.

7. The apparatus of claim 1 wherein said fuel supply means comprises:

a fuel source;

a conduit coupling said source to said mixing chamber in said air-fuel mixing means; and a check valve located in said conduit adjacent the point where the latter is coupled to said mixing chamber.

8. The apparatus of claim 3 wherein said air compressor is driven by a battery-powered electric motor.

9. The apparatus of claim 3 wherein said air compressor is driven by mechanical connection to said engine.

10. The apparatus of claim 3 wherein said cutoff valve and said air-fuel injector valve include solenoid actuator means and wherein said control means comprises electrical circuit means connecting said solenoid actuators to the ignition starting control circuit of said engine whereby said air-fuel mixing means and said injector valve are selectively actuated during the startup cycle of said engine.

11. The apparatus of claim 10 wherein said electrical circuit means further comprises:

a timing circuit for generating a limited-duration control pulse in response to the actuation of said ignition starting control circuit; and gating circuit means for inhibiting the operation of said electrical circuit means when said limited-duration control pulse is not present.

12. The apparatus of claim 10 wherein said electrical circuit means further comprises:

a temperature sensing circuit for generating a control signal when said engine is cold; and gating circuit means for inhibiting the operation of said electrical circuit means when said control signal is not present.

13. A method for starting an internal combustion engine having carburetion means including a throttle control arranged to supply a combustible air-fuel mixture to said engine through an intake manifold comprising the steps of:

closing said throttle control to minimize the supply of said air-fuel mixture to said engine from said carburetion means;

operating the starter motor and ignition of said engine; and injecting, while said throttle control is closed and said starter and ignition are in operation, a limited charge of pressurized air mixed with fuel into said intake manifold through a fuel injector valve located downstream of said throttle control, whereby a controlled quantity of air mixed to provide a highly volatile and combustible air-fuel mixture is introduced into said engine to induce engine startup.

14. The method of claim 13 wherein said air-fuel mixture comprises an air-fuel ratio of from 14-to-1, stoichometric, to an air fuel mix of 1-to-1.

15. Apparatus for supplying a highly combustible air-fuel mixture to an internal combustion engine during engine startup, said engine including carburetion means having a throttle control arranged to supply an air-fuel mixture through an intake manifold, said apparatus comprising, in combination:

a fuel injector valve coupled to said intake manifold downstream of said throttle control and having an inlet and further including an outlet nozzle in communication with said intake manifold;

air-fuel mixing means connected to supply a combustible mixture to said injector valve inlet and including a Venturi throat, said mixing means including means for directing a flow of pressurized air to said inlet through said Venturi throat, said last mentioned means including an air compressor, a first conduit connected to supply pressurized air from said compressor to said Venturi throat, and a selectively operable cutoff valve in said first conduit for regulating the supply of pressurized air to said fuel injector valve;

means for supplying fuel into said flow of pressurized air, said fuel being drawn into and mixed with said flow by the pressure differential produced at said Venturi throat, said fuel supply means including a fuel source and a second conduit coupling said source to said Venturi throat in said air-fuel mixing means;

valves located in said first and second conduits solenoid actuating means constructed and arranged to control said cutoff valve and said fuel injector valve; and manually operable electrical switch means connected to simultaneously energize said solenoid actuators whereby an operator can manually control said air-fuel mixing means and said injector valve to cause a highly combustible mixture of air and highly atomized fuel to be fed to said engine intake manifold through said injector valve during engine startup.

16. Apparatus for supplying a volatile air-fuel mixture to an internal combustion engine having a carburetor and an intake manifold coupled thereto; comprising, in combination:

air-fuel mixing means connected to supply an air-fuel mixture to said engine intake manifold and including a mixing chamber, said mixing means including means for directing a flow of pressurized air to said manifold through said mixing chamber;

means for supplying fuel into said flow of pressurized air whereupon said fuel is mixed with said air in said mixing chamber;

control means for selectively operating said air-fuel mixing means whereby a mixture of air and highly combustible atomized fuel is fed to said engine via said intake manifold;

a manually operable throttle control linked to said carburetor to control the flow of fuel to said engine therefrom;

a solenoid controlled valve included in said air-fuel mixing means for controlling the flow of said pressurized air through said mixing chamber; and a motion sensing control switch included in said control means and constructed and arranged to detect movement of said throttle control and to actuate said solenoid controlled valve to cause a charge of highly combustible air-fuel mixture to be supplied to said intake manifold in response to an acceleration motion of said throttle control.

17. The apparatus of claim 16 wherein said air-fuel mixing means further includes a Venturi throat communicating with said mixing chamber and constructed and arranged such that said fuel is drawn into and mixed with said flow of pressurized air by the pressure differential produced at said Venturi throat.

18. The apparatus of claim 17 wherein said means for supplying fuel into said flow of pressurized air comprises:

a float chamber;

a first fuel line connecting said float chamber to said Venturi throat;

a fuel tank;

a second fuel line connecting said tank with said float chamber; and a metering valve provided in said second line to meter the flow of fuel into said float chamber to maintain a substantially constant fuel level therein.

19. Apparatus for supplying a volatile air-fuel mixture to an internal combustion engine having a carburetor and an intake manifold coupled thereto; comprising, in combination:

air-fuel mixing means connected to supply an air-fuel mixture to said engine intake manifold and including a mixing chamber, said mixing means including means for directing a flow of pressurized air to said manifold through said mixing chamber and a valve for controlling the flow of said pressurized air through said mixing chamber;

means for supplying fuel into said flow of pressurized air whereupon said fuel is mixed with said air in said mixing chamber;

control means for selectively operating said air-fuel mixing means whereby a mixture of air and highly combustible atomized fuel is fed to said engine via said intake manifold;

a manually operable movable throttle control linked to the carburetor to control the flow of fuel to said engine;

said control means including means responsive to an acceleration movement of said throttle control to actuate said valve to cause a highly combustible air-fuel mixture to be supplied to the intake manifold of the engine.

20. Apparatus according to claim 19 wherein said control means includes means for operating said air-fuel mixing means during engine startup for supplying an initial charge of highly combustible atomized fuel and air to the engine to assist engine startup.

21. Apparatus according to claim 20 wherein said air-fuel mixing means includes an air compressor and a conduit connected to supply pressurized air from said compressor to said mixing chamber, said valve being in said conduit for regulating the supply of pressurized air to said air-fuel mixing means.

22. Apparatus according to claim 21 further comprising a check valve located in said conduit adjacent the point where the latter is coupled to said mixing chamber.

23. Apparatus according to claim 21 wherein said air-fuel mixing means further comprises:

a Venturi throat communicating with said mixing chamber and constructed and arranged such that said fuel is drawn into and mixed with said flow of pressurized air by the pressure differential produced at said Venturi throat.

24. Apparatus according to claim 21 wherein said fuel supply means comprises:

a fuel source;

a conduit coupling said source to said mixing chamber in said air-fuel mixing means; and a check valve located in said conduit adjacent the point where the latter is coupled to said mixing chamber.

25. Apparatus for starting an internal combustion engine by supplying a volatile air-fuel mixture to the engine during engine start-up comprising, in combination:

air-fuel mixing means connected to supply, prior to starting the engine, an air-fuel mixture to the engine and including a mixing chamber, a source of air under pressure, and means for directing a flow of pressurized air from said air source through said mixing chamber;

means for supplying fuel into said flow of pressurized air whereupon said fuel is mixed with said air in said mixing chamber; and control means for operating said air-fuel mixing means during engine start-up including a source of electrical power and means for selectively coupling said electrical power source and said air source one to the other to actuate said air source, prior to starting the engine, to supply air to said directing means, whereby a mixture of air and highly combustible, atomized fuel is supplied to the engine to start the engine, and means for disabling said control means after engine startup.

26. Apparatus according to claim 25 wherein said air-fuel mixing means is operated to supply a substantially stoichmetric air-fuel mixture to the engine.

27. Apparatus according to claim 25 wherein said source of air under pressure includes an air compressor, a conduit connected to supply pressurized air from said compressor to said directing means, and a selectably operable cut-off valve in said conduit for controlling the supply of pressurized air to the engine.

28. The apparatus according to claim 25 wherein said air-fuel mixing means further comprises a Venturi throat communicating with said mixing chamber and constructed and arranged such that the fuel is drawn and mixed with said flow of pressurized air by the pressure differential produced by said Venturi throat.

29. Apparatus for starting an internal combustion engine by supplying a volatile air-fuel mixture to the engine during engine start-up comprising, in combination:

air-fuel mixing means connected to supply, prior to starting the engine, an air-fuel mixture to the engine and including a mixing chamber, a source of air under pressure, and means for directing a flow of pressurized air from said air source through said mixing chamber;

means for supplying fuel into said flow of pressurized air whereupon said fuel is mixed with said air in said mixing chamber; and control means for operating said air-fuel mixing means during engine start-up including means for controlling the flow of pressurized air from said source, prior to starting the engine, to supply air to said directing means, whereby a mixture of air and highly combustible, atomized fuel is supplied to the engine to start the engine, and means for disabling said control means after engine startup.

30. Apparatus according to claim 29 wherein said air-fuel mixing means is operated to supply a substantially stoichmetric air-fuel mixture to the engine.

* * * * *